US006913449B2

(12) United States Patent
Loeser et al.

(10) Patent No.: US 6,913,449 B2
(45) Date of Patent: Jul. 5, 2005

(54) APPARATUS FOR THE TREATMENT OF METALLIC WORKPIECES WITH COOLING GAS

(75) Inventors: Klaus Loeser, Mainhausen (DE); Georg Stueber, Rodenbach (DE); Gerhard Welzig, Frankfurt am Main (DE); Volker Heuer, Frankfurt am Main (DE)

(73) Assignee: ALD Vacuum Technologies AG, Hanau (DE)

( * ) Notice: Subject to any disclaimer, the term of this patent is extended or adjusted under 35 U.S.C. 154(b) by 198 days.

(21) Appl. No.: 10/382,708

(22) Filed: Mar. 6, 2003

(65) Prior Publication Data

US 2003/0175130 A1 Sep. 18, 2003

(30) Foreign Application Priority Data

Mar. 13, 2002 (DE) ..... 102 10 952

(51) Int. Cl.[7] ..... F04B 17/00; F04B 23/00; F04B 39/00; C21D 1/74; C21D 1/76

(52) U.S. Cl. ..... 417/423.15; 417/313; 417/527; 266/250

(58) Field of Search ..... 417/423.8, 423.15, 417/423.14, 313, 572; 266/250; 29/722

(56) References Cited

U.S. PATENT DOCUMENTS 4,610,435 A * 9/1986 Pfau et al. ..... 266/250
H000777 H * 5/1990 Natarajan ..... 148/660
5,121,903 A * 6/1992 Ripley et al. ..... 266/250

FOREIGN PATENT DOCUMENTS

DE 32 08 574 A1 9/1983
FR 1 204 662 1/1960

* cited by examiner

*Primary Examiner*—Cheryl Tyler
*Assistant Examiner*—Timothy P. Solak
(74) *Attorney, Agent, or Firm*—Fulbright Jaworski L.L.P.

(57) ABSTRACT

In an apparatus for the treatment of metallic workpieces (4) with cooling gas, having a cylindrical housing (3) with an opening at the end face for introducing and removing the workpieces (4), two support plates (6, 7) extending in parallel planes vertically in the housing (3) and two air-guiding plates (14, 15) are provided, the workpiece batch (4) being held between the support plates (6, 7), and the air-guiding plates (14, 15) each forming, with the adjacent support plates (6, 7) and with the respectively adjacent inner wall of the housing, shafts (16, 17 and 26, 27, respectively) through which the cooling gas conveyed by blowers held on the housing (3) flows, controlled by reversing flaps (18, 19, 20, 21) arranged at the upper and lower ends of the air-guiding plates (14, 15).

2 Claims, 1 Drawing Sheet

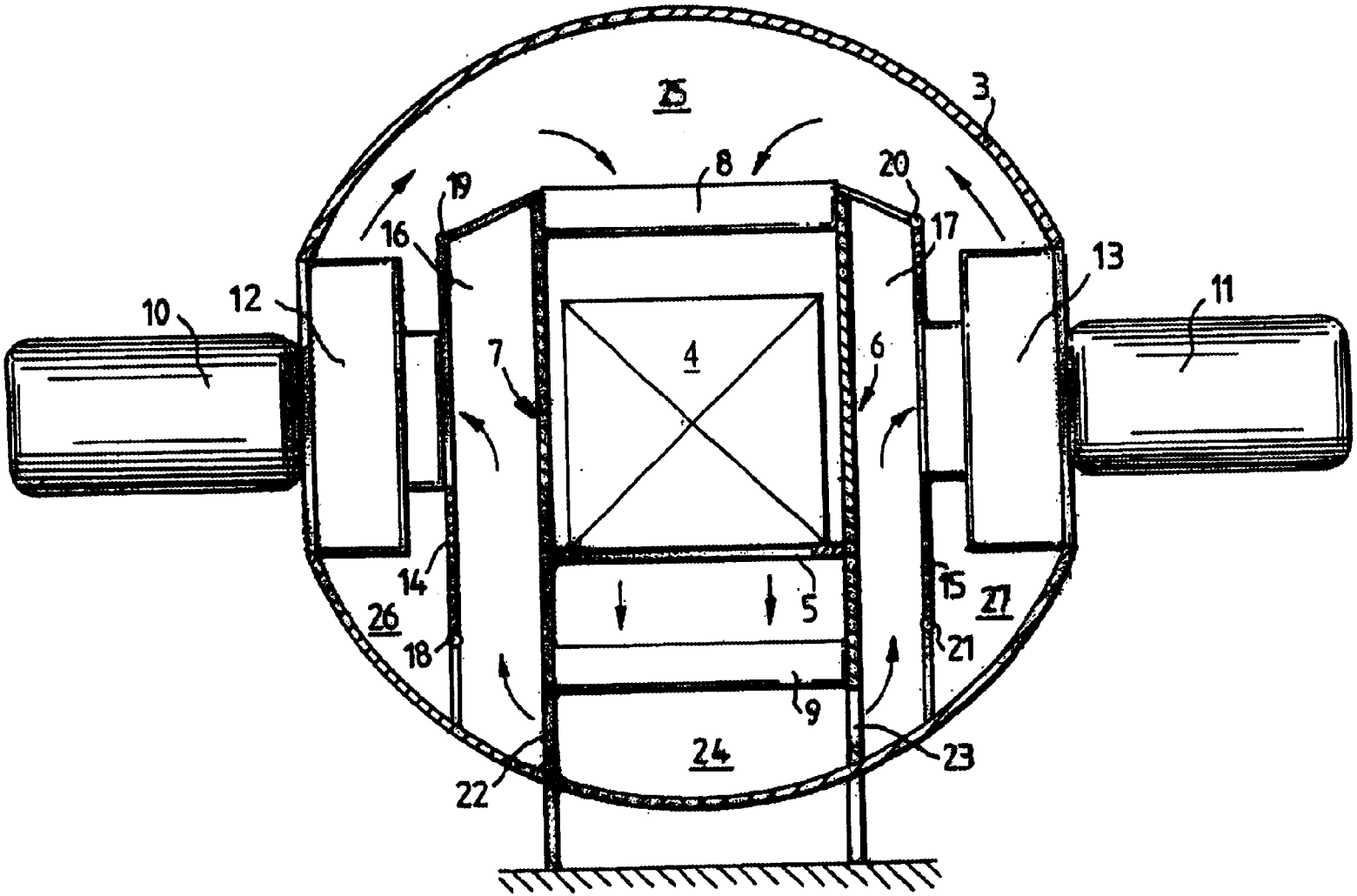
3
11
13
17
20
6
8
25
4
5
9
24
7
19
16
12
10
15
21
27
23
22
14
18
26

APPARATUS FOR THE TREATMENT OF METALLIC WORKPIECES WITH COOLING GAS

FIELD OF THE INVENTION

The invention relates to an apparatus for the treatment of metallic workpieces with cooling gas, having a housing with an opening for introducing and removing the workpieces, having a cooling-gas source, by means of which blower-conveyed cooling gas guided via heat exchangers is fed to the workpieces, and having a workpiece support.

BACKGROUND AND SUMMARY OF THE INVENTION

Vacuum furnaces for the plasma carburisation of metallic workpieces by means of a carbon-containing gas, for example methane or propane, are known. During the plasma carburisation, the workpieces are heated in the vacuum furnace to a temperature of between about 800° C. and 1050° C. Subsequently, the carbon-containing process gas is led into the furnace chamber and an electric field is applied to the workpiece batch. Thereafter, for the purpose of hardening, the batch is cooled by blowing it with cooling gas emerging from nozzles onto the batch, helium, in particular, having proved successful as the cooling gas.

By way of example, a vacuum shaft furnace is known (DE 32 08 574 A1) which has a device for cooling the heat-treated batch by means of a gas flow guided through the interior of the preferably cylindrical heating chamber via openings and circulated outside the heating chamber in the closed furnace housing by a gas blower via a gas cooler, closable openings being arranged in the floor and the roof for a vertical flow in the heating chamber, and closable openings lying one above the other being arranged at opposite locations in the side wall of the heating chamber over its entire height for a horizontal flow. To close the openings in the wall of the heating chamber there are provided cover plates which cover all the openings, each contain openings congruent with the openings in the side walls and are displaceable by half an opening spacing.

Furthermore, a vacuum furnace for the plasma carburisation of metallic workpieces is known (EP 0 535 319 B1) which has an electrical heater, a vacuum pump for generating a vacuum in the heating chamber, and gas inlet openings, by means of which cooling gas conveyed by a blower and guided via a heat exchanger is fed to the batch, the gas inlet openings which guide the cooling gas being arranged in the heating chamber and aligned with the batch. The nozzles designed as gas inlet openings are arranged all around the heating chamber and at the ends, the end nozzles serving to introduce the cooling gas axially into the heating chamber. A vacuum furnace for plasma carburisation designed in such a manner makes it possible to harden the carburised batch to complete the heat-treatment process, without having to remove the batch from the heating chamber to do so. Since all the heat-treatment steps can be performed exclusively within a heating chamber, the space requirement of a single furnace is also relatively small. Since the gas guidance and the gas flow are crucial factors for the quenching process, but a reversal of the flow direction of the cooling gas cannot be accomplished with the aforementioned vacuum furnaces, it has also been proposed to equip the furnace housing with two chambers separated from each other by a closing slide and to arrange the heating elements and a hot-gas fan in one chamber and the cooling fan and the heat exchanger with suitable flow plates in the other chamber. With this type of furnace, the batch is firstly heated up and carburised in one chamber and then, with the closing slide open, moved into the other chamber for the purpose of quenching.

The most fundamental disadvantage of all known vacuum furnaces, however, is that renewed charging of the furnaces is only ever possible after total completion of the previous treatment process in each case, and this means, where large-scale manufacture is required, setting up a large number of complete vacuum furnaces. Since, however, the first phase of the heat-treatment process, namely the heating-up and carburising of the batch, takes a relatively long time compared with the second phase, namely the hardening process, the object on which the present invention is based is to provide an apparatus for the treatment of metallic workpieces with cooling gas which avoids the disadvantages of known furnaces and with a very compact construction—with a low ratio of chamber volume to batch volume—enables a rapid flow reversal, and in which mirror-symmetrical flow conditions exist after the flow reversal. Furthermore, the apparatus is to be of single-walled design and, from the very beginning of the quenching phase, enable a high heat transfer coefficient at all the workpieces within the batch, is to require a small amount of quenching gas per quenching operation and permit operation with particularly short cycle times. Finally, the apparatus is to be designed so as to enable controlled quenching—i.e. with variable intensity—and to be capable of being coupled to existing carburising furnaces, so that a plurality of simple furnaces—without heat exchanger and cooling-gas blower—can be operated with a single apparatus, which reduces costs and saves space.

This object is achieved according to the invention by an apparatus having a housing for introducing and removing the workpieces, having a cooling-gas source, by means of which blower-conveyed cooling gas guided via heat exchangers is fed to the workpieces, having a workpiece support with support plates arranged on both sides of the workpiece support, extending vertically and parallel to one another, separating the workpieces from lateral spaces and provided with openings, and having heat exchangers held, above and/or below the workpieces, between the support plates, and having blower motors, provided on both sides of the housing, with shafts extending into the lateral spaces horizontally and at right angles to the axis of the housing, the blower wheels, which rotate with the shafts in blower housings, each being provided close to the inner wall of the housing and being separated from the support plates by air-guiding plates which, each held by the blower housings, extend parallel to and at a distance from the support plates and with the support plates each form, on both sides of the workpiece batch, two vertically extending shafts for guiding the cooling-gas stream, reversing flaps being mounted at each of the upper and lower ends of the two air-guiding plates and, depending on the position, sealingly butting against the support plates or against the inner wall of the housing.

Further details and features are described in more detail below.

The invention permits a wide variety of possible embodiments; one of these is illustrated in the appended drawing, which shows an apparatus purely schematically in cross-section.

BRIEF DESCRIPTION OF THE FIGURE

The FIGURE shows a schematic of an apparatus according to the invention in cross-section.

DETAILED DESCRIPTION

The apparatus comprises a cylindrical, single-walled housing 3, one end of which is firmly closed by a cover and the other end of which can be closed by means of a door or a slide and otherwise is configured and dimensioned in such a way that the workpiece batch 4, which has been heated up and carburised in a separate furnace, can be transferred into the housing 3 of the apparatus without additional transporting equipment being required for this purpose. Arranged in the housing 3 is a workpiece support 5 in the form of a perforated or apertured plate, on which the batch 4 rests. Arranged on both sides of the batch 4 are strongly designed support plates 6, 7, on which the workpiece support 5 is held and between which heat exchangers 8, 9 are located. Provided on both sides of the housing 3, on the outer side of the latter, are blower motors 10, 11, the motor shafts of which are sealingly led through the wall of the housing 3, the two motor shafts extending in mutual alignment and horizontally. The blower housings 12, 13 themselves are each firmly connected to the housing 3 and each hold at their end face an air-guiding plate 14, 15. which extends parallel to and at a distance from the respectively adjacent support plate 6 and 7 and with the latter forms a shaft 16 and 17. Mounted at the upper and lower edges, running parallel to the longitudinal direction of the housing, of the air-guiding plates 14, 15 are in each case reversing flaps 18, 19, 20, 21, these flaps being dimensioned and mounted in such a way that they each have their free ends either corresponding with or lying against the respectively adjacent support plates 6 and 7, or else butting against the inner wall of the housing 3 when they are in a position pivoted by about 80°. As the drawing shows, the two reversing flaps 19, 20 mounted at the upper ends of the air-guiding plates 14, 15 are pivoted in such a way that their free ends lie against the upper edges of the support plates 6, 7 and close the shafts 16, 17 at the top. In contrast, the two reversing flaps 18, 21 mounted at the lower edges of the air-guiding plates 14, 15 have their free ends lying against the inner wall of the housing 3 and have the effect that the cooling gas entering the region 24 below the heat exchanger 9 enters the shafts 16, 17 from below in the direction of the arrows, for which purpose the lower parts of the support plates 6, 7 are provided with openings 22, 23. The cooling gas which flows upwards in the shafts 16, 17 enters the central intake openings of the blower housings 12, 13 and is thereafter forced out again into the region 25 above the upper heat exchanger 8 and then flows through the heat exchanger 8 onto the workpiece batch 4 and from the latter through the heat exchanger 9 into the region 24 again. For flow reversal, the four reversing flaps 18, 19, 20, 21 are each pivoted into their other position.

Owing to the arrangement of the two heat exchangers 8, 9 above and below the batch 4, respectively, cold cooling gas is always present at the blower wheels and at the housing of the apparatus. The effect achieved by the specific setting of the reversing flaps 18, 19, 20, 21 is that the circulating movement of the cooling gas takes place only in the outer region; so that a rapid lowering or raising of $\alpha$ can be brought about. Through a specific setting of the reversing flaps 18, 19, 20, 21 it is possible to achieve a defined throttling of the volumetric flow, so that the interrupted hardening and hot quenching can be obtained.

The support plates 6, 7 are expediently provided, on their side face-directed towards the batch 4, with a reflective coating or are produced from a material with a high reflectance, the plates themselves having a low heat capacity. Radiation from the edge regions of the batch towards the cold wall is thereby reduced, which minimises distortion and improves the uniformity of the hardness distribution. It should be mentioned that, in an alternative embodiment, the motor shafts are not sealingly led through the wall of the housing 3, but rather the housings of the motors 10, 11 are themselves designed to be pressure-proof, so that a change in pressure via the shaft leadthroughs in the interior of the housing 3 is precluded.

What is claimed is:

1. Apparatus for the treatment of metallic workpieces with cooling gas, having a cylindrical housing with an opening for introducing and removing the workpieces, having a cooling-gas source, by means of which blower-conveyed cooling gas guided via heat exchangers is fed to the workpieces, and having a workpiece support with support plates arranged on both sides of the workpiece support, extending vertically and parallel to one another, separating the workpieces from lateral spaces and provided with openings, and having heat exchangers held, at least one of above or below the workpieces, between the support plates, and having blower motors, arranged on both sides of the cylindrical housing, with shafts extending into the lateral spaces horizontally and at right angles to the longitudinal axis of the cylindrical housing, blower wheels, which rotate with the shafts in a blower housing, each being provided close to the inner wall of the cylindrical housing and being separated from the support plates by air-guiding plates which, each held by the blower housings, extend parallel to and at a distance from the support plates and with the support plates each form, on both sides of the workpiece batch, two vertically extending shafts for guiding the cooling-gas stream, reversing flaps being mounted at each of an upper and a lower end of the two air-guiding plates and, depending on the position, sealingly butting against the support plates or against the inner wall of the cylindrical housing.

2. Apparatus according to claim 1, wherein the blower motors are held outside and the blower housings inside the cylindrical housing, the blower inlet in each case opening into a vertically extending shaft and the blower outlet into the space adjacent to the shaft and bounded by the inner wall of the cylindrical housing and an air-guiding plate.

* * * * *